United States Patent [19]

Suzuki et al.

[11] 4,080,268

[45] Mar. 21, 1978

[54] METHOD FOR HIGH SPEED CHROMIUM PLATING OF CYLINDRICAL ARTICLES

[75] Inventors: Shoji Suzuki, Omiya; Keiichi Yoda, Hiratsuka; Hiroshi Suzuki, Urawa; Isao Yaguchi; Hitoshi Karasawa, both of Yono, all of Japan

[73] Assignee: Nippon Piston Ring Co., Ltd., Tokyo, Japan

[21] Appl. No.: 763,746

[22] Filed: Jan. 28, 1977

[30] Foreign Application Priority Data

Jul. 13, 1976 Japan ..... 51-83159

[51] Int. Cl.[2] ..... C25D 5/08; C25D 7/04

[52] U.S. Cl. ..... 204/25; 204/218

[58] Field of Search ..... 204/23, 25, 212, 218

[56] References Cited

U.S. PATENT DOCUMENTS

| | | | |
|---|---|---|---|
| 644,029 | 2/1900 | Cowper-Coles | 204/212 |
| 680,408 | 8/1901 | Cowper-Coles | 204/212 |
| 895,163 | 8/1908 | Cowper-Coles | 204/212 |
| 1,127,966 | 2/1915 | Cowper-Coles | 204/212 |

*Primary Examiner*—T. M. Tufariello

*Attorney, Agent, or Firm*—Sughrue, Rothwell, Mion, Zinn and Macpeak

[57] ABSTRACT

A method for the high speed chromium plating of piston rings, cylinder liners and the like wherein the cathodic workpiece is rotated at a peripheral speed of 1–4 m/sec. relative to a concentrically disposed anode. The latter may comprise a single spoked member or a plurality of rectangular pieces to thereby create a turbulence in the electrolyte bath. When a cylindrical anode is used, a bladed agitator is secured to the rotating workpiece to generate turbulence. The interelectrode spacing is from 0.1 to 4t cm with a multipolar anode, where t is the thickness of an anode pole. The current density is from 200 – 600 amps/dm$^2$, and the bath temperature is from 20° – 50° C or from 65° – 80° C, depending on the plating characteristics desired.

4 Claims, 13 Drawing Figures

METHOD FOR HIGH SPEED CHROMIUM PLATING OF CYLINDRICAL ARTICLES

BACKGROUND OF THE INVENTION

This invention relates to a method for the high speed chromium plating of cylindrical articles, such as piston rings or cylinder liners.

Heretofore, experiments in the high-speed chromium plating of cylindrical articles, such as piston rings or cylinder liners, have indicated in general that rotating the article (cathode) and decreasing the interelectrode distance are effective to increase the plating speed. However, a number of problems still exist with regard to the high-speed plating of such articles on a mass production basis. As stated above, high-speed chromium plating has only been accomplished on an experimental basis, and no detailed parameters have been developed concerning the rotational speed of the workpiece vis a vis the degree of decrease of the interelectrode spacing. Thus, extreme difficulty has been experienced in setting the precise conditions for the high-speed chromium plating of cylindrical articles on a mass production basis, and chromium plated coatings having good wear resistance and adhesion have not yet been obtained.

SUMMARY OF THE INVENTION

This invention clarifies the conditions for the high-speed chromium plating of cylindrical articles on a mass-production basis, and provides a method for efficiently obtaining a chromium plated layer having good wear resistance and adhesion within a short period of time.

According to the invention a plated surface having moderate raised and depressed portions, which serve as oil pockets, are formed without any complicated processing, such as inverse current treatment, by adjusting the temperature of the plating bath in a range of 20° to 50° C or 65° to 80° C.

Briefly, the article or workpiece is centrally disposed in a plating bath tank, having flat plate-like anodes radially surrounding the article and in proximity to its surface (spaced at a distance of from 0.1 cm. to four times the thickness of the anode), to thereby generate a turbulent flow in the bath when the workpiece is rotated at an outer peripheral speed of about 1 to 4 m/sec. An electric current having a density of about 200 to 600 A/dm$^2$ is passed between the thus disposed electrodes to perform chromium plating on the outer periphery of the workpiece.

When the inner periphery of the workpiece is to be chromium plated, flat plate-like anodes or a star-shaped anode are radially disposed at the central part of the plating bath tank to generate a turbulent flow near the surface of the workpiece in the bath, and chromium plating is performed with the distance between the inner surface of the workpiece and the anode(s), The inner peripheral speed of the workpiece, and the current density as described above.

Alternatively, a turbulent flow may be produced by securing an agitator or fan member to the rotating workpiece, in which case the anode may have a solid or hollow cylindrical shape.

DETAILED DESCRIPTION OF THE PREFERRED EMBODIMENTS

Figure 1:
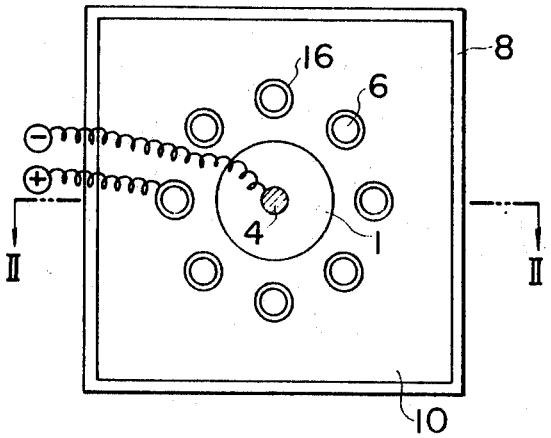
FIG. 1 is a schematic plan view showing an embodiment according to the invention in which the outer periphery of a workpiece is plated.
Figure 2:
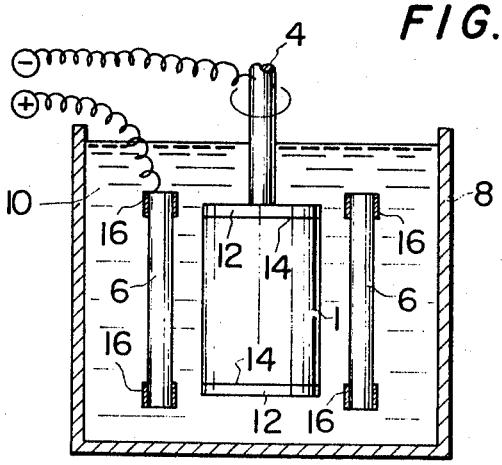
FIG. 2 is an elevation taken along lines 2—2 of FIG. 1.

FIGS. 1 and 2 are schematic views showing an embodiment wherein chromium plating is applied to the outer periphery of a workpiece having a cylindrical cross section. Workpiece 1 to be plated (the cathode) rotates around a shaft 4 supported on a suitable bearing (not shown) and connected to a driving source (not shown) whose speed is variable, whereby the outer peripheral speed of the workpiece can be varied between from 1 to 4 m/sec. according to its outside diameter. If the speed is below 1 m/sec., a sufficient turbulent flow will not be formed near the surface of the work, and with existing techniques it is physically and mechanically impossible to increase the speed beyond 4 m/sec. As a result of adjusting the outer peripheral speed to 1 – 4 m/sec., high current density plating is possible, and a chromium plated layer having superior wear resistance can be efficiently obtained. The current density should be from 200 – 600 A/dm$^2$. Below 200 A/dm$^2$ the plating effeciency is almost the same as with conventional techniques. On the other hand, above 600 A/dm$^2$ the plating effeciency does not appreciably increase. A current collector (not shown) is provided on the shaft 4, and the workpiece is connected through it to the negative pole of an electric source (not shown).

Figure 3:
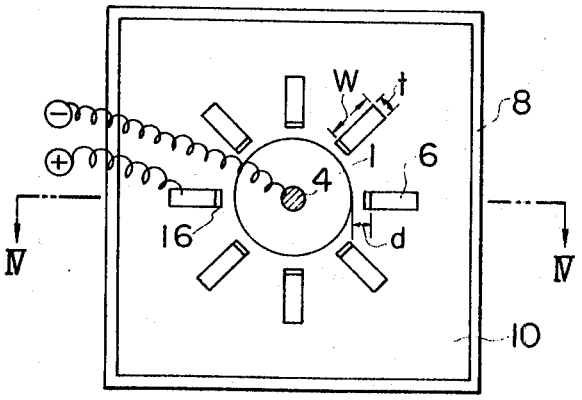
FIG. 3 is a schematic plan view showing another embodiment of the invention.
Figure 4:
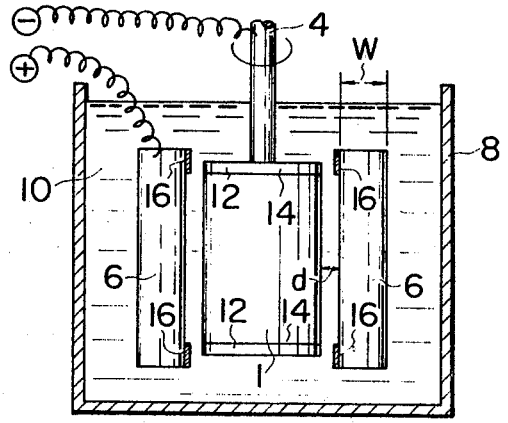
FIG. 4 is an elevation taken along lines 4—4 of FIG. 3.

The anodes 6 may be cylindrical in shape as heretofore used, but to effectively generate a turbulent flow in a plating bath 10 within a tank 8, it is advantageous to give the anodes 6 a flat plate-like shape having a thickness $t$ and a width $w$ as shown in FIGS. 3 and 4, and dispose the anodes radially around the rotating workpiece. The thickness $t$ of the anode is suitably determined according to the size of the workpiece, and the width $w$ is such that $w \geqq t$. The distance $d$ between the outer surface of the workpiece and the inner end of the anode (interelectrode distance) should be determined so that the plating bath can freely flow between them, and a turbulent flow is generated effectively. Experimental work has shown that this distance $d$ is preferably from 0.1 to $4t$ cm. When the interelectrode distance is below 0.1 cm the plating bath cannot sufficiently flow between the electrodes, and if it exceeds $4t$ cm a sufficient turbulent flow cannot be produced in the plating bath.

The workpiece 4 is supported by clamp members 12. To obtain a plated layer having a uniform thickness in the vertical direction by preventing both the plating of these clamp members and the formation of a thick plated coating locally on the areas of the workpiece near the clamp members, it is desirable to cover the inner surfaces of the tips of the anodes 6 with a sealing material 16 such as polyethylene extending outwardly from the planar interface 14 between the workpiece and the clamp members.

Figure 5:
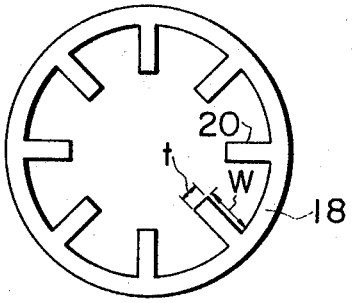
FIG. 5 shows another anode shape that can be used in the embodiments shown in FIGS. 1 to 4.

Instead of providing flat, disposed, plate-like anodes, an anode as shown in FIG. 5 may be used which consists of an annular body 18 and a plurality of flat plate-like concentered projections 20 formed on the inside surface thereof.

Figure 6:
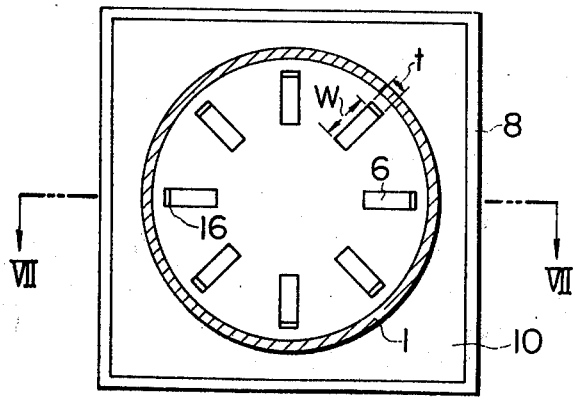
FIG. 6 is a schematic plan view showing an embodiment of the invention in which chromium plating is applied to the inner periphery of a workpiece.
Figure 7:
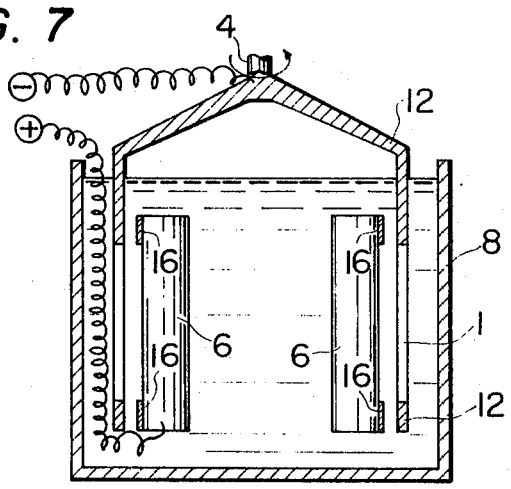
FIG. 7 is an elevation taken along lines 7—7 of FIG. 6.

FIGS. 6 and 7 are schematic views of an embodiment for applying chromium plating to the inner peripheral surface of a workpiece. In this and subsequent embodiments, the same reference numerals are used to designate elements which are substantially the same as those shown in FIGS. 1 and 2.

In this embodiment, cylindrical anodes as shown in FIGS. 1 and 2 may also be used. Ideally, however, flat plate-like anodes 6 each having a thickness $t$ and a width $w$ are radially disposed at the center of tank 8. The thickness $t$ and the width $w$ are determined as described above, and once again the distance $d$ between the inner peripheral surface of the work and the outside faces of the anodes 6 are from 0.1 – $4t$ cm, and the rotational speed of the inner peripheral surface of the workpiece is 1 to 4 m/sec. The outside surfaces of the top and bottom ends of the anodes 6 are again preferably covered with a sealing material 16 such as polyethylene, as described above. The upper clamp member 12 may have a spider configuration to facilitate the flow of the electrolyte.

Figure 8:
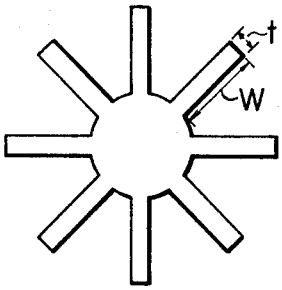
FIG. 8 shows another anode shape that can be used in the embodiment shown in FIGS. 6 and 7.

A star-shaped anode such as that shown in FIG. 8 can alternatively be employed.

Figure 9:
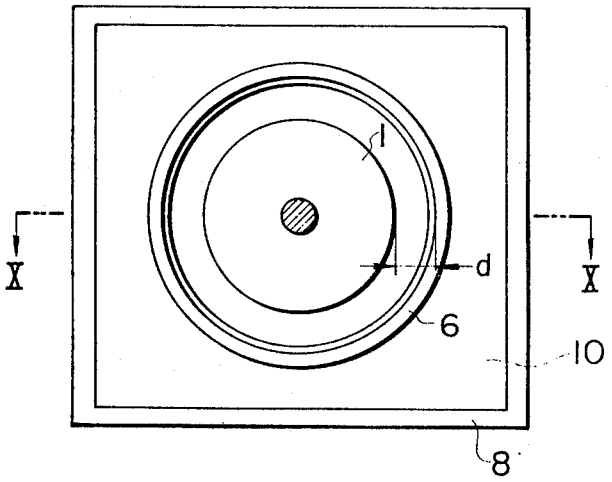
FIG. 9 is a schematic plan view showing an embodiment in which chromium plating is applied to the other periphery of a workpiece by forcibly stirring the plating bath with fan means secured to the workpiece.
Figure 10:
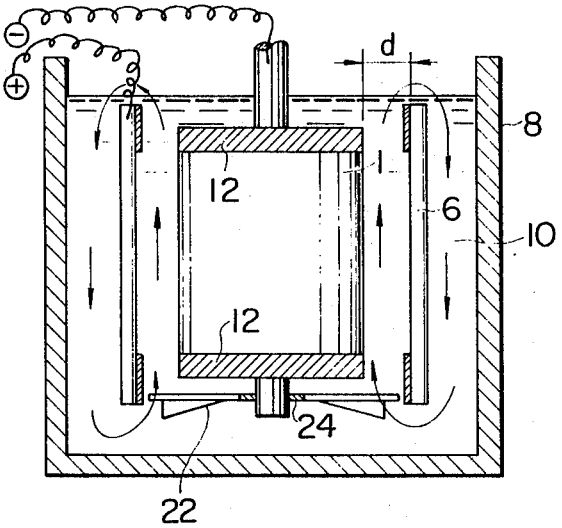
FIG. 10 is an elevation taken along lines 10—10 of FIG. 9.

FIGS. 9 and 10 show an embodiment for chromium plating the outer peripheral surface of a workpiece 1. In this embodiment, however, an agitator or fan 22 is secured to clamp member 12 through an insulator 24 to create a turbulent flow in the plating bath 10. The fan 22 is rotated together with the workpiece.

Since the plating bath 10 is forcibly stirred by the fan 22, the interelectrode distance $d$ can be set at an optional value so that the plating bath can freely flow through the gap and a turbulent flow can be effectively produced. Better results are obtained with a cylindrical anode because it ensures a more uniform agitation of the bath. As in the above embodiments, the outer peripheral speed of the workpiece is from 1 to 4 m/sec.

Figure 11:
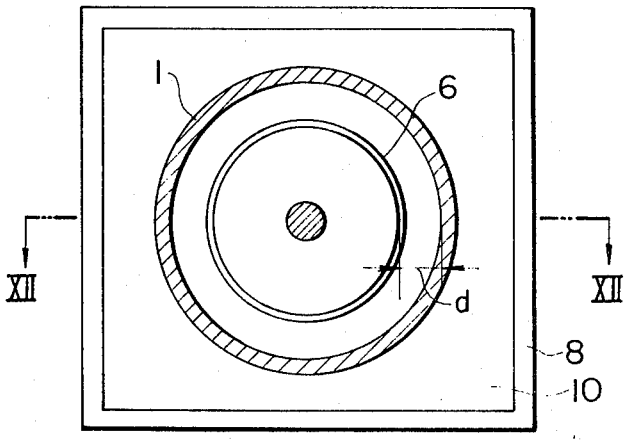
FIG. 11 is a schematic plan view showing an embodiment in which chromium plating is applied to the inner periphery of a workpiece by forcibly stirring the plating bath with fan means.
Figure 12:
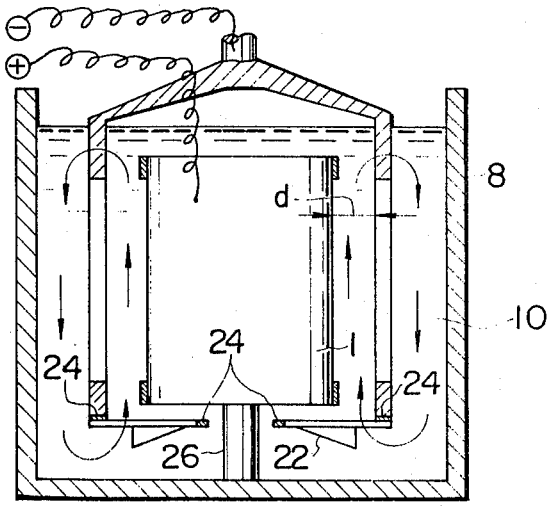
FIG. 12 is an elevation taken along lines 12—12 of FIG. 11.

FIGS. 11 and 12 show an embodiment for chromium plating the inner peripheral surface of a workpiece wherein the plating bath 10 is forcibly agitated by the rotation of a fan 22 secured to the rotating workpiece 1 through an insulator ring 24. Once again, since the plating bath 10 is forcibly stirred by the fan 22, the interelectrode distance $d$ can be varied as desired. The centrally disposed anode 6 is cylindrical in shape, and is fixed to the tank 8 by a support 26 extending through the center of the fan 22. The inner peripheral speed of the workpiece is again from 1 to 4 m/sec.

A comparative experiment of the high-speed chromium plating method of this invention and a conventional chromium plating method was performed, and the results are shown in Table 1 below.

Table 1

| | High-speed chromium plating method in accordance with the invention | | Conventional chromium plating method | |
|---|---|---|---|---|
| | Experiment 1 | Experiment 2 | Experiment 3 | Experiment 4 |
| Bath temperature (° C) | 50 | 71 | 50 | 63 |
| Rotating speed (m/sec) | 1.25 | 1.25 | — | — |
| Current density ($A/dm^2$) | 370 | 370 | 55 | 60 |
| Plating speed ($\mu$/min.) | 10.0 | 4.8 | 0.5 | 0.98 |
| Hardness (Hv) | 840 | 1006 | 983 | 992 |
| Number of cracks per cm | 20 | 95 | 720 | 860 |
| Type of the bath | Sargent bath | Sargent bath | Sargent bath | Silicofluoride bath |
| Composition of bath (g/l) | | | | |
| $CrO_3$ | 250 | | 250 | |
| $H_2SO_4$ | 2.5 | | 1.2 | |
| $Na_2SiF_6$ | none | | 5 | |

As can easily be seen, the current density according to the present invention can be increased more than 6 times as compared with the conventional method, and as a result the plating speed increases to about 20 times that in the conventional method in a comparative experiment using the sargent bath, and the number of cracks is reduced to between 1/39 and 1/40.

It is also very advantageous to adjust the temperature of the plating bath to a range of 20° to 50° C. When the plating bath temperature is so adjusted, moderate raised and depressed portions, having a granular form, are formed on the surface of the plated coating. These portions serve as oil pockets after a simple surface smoothening treatment, which leaves just the deepest recesses or bottoms of the depressed portions.

Accordingly, no conventional inverse current treatment is required to form the necessary oil pockets. If the plating bath temperature is below 20° C, the surface of the plated coating is too smooth to be usable. If it is between 50° C and 65° C, the surface is too rough, and it becomes necessary to resort to an inverse current treatment to form the oil pockets.

With a bath temperature of 65° to 80° C, the plating speed becomes somewhat slower than with a temperature range of 20° to 50° C, but the surface roughness of the plated coating drops down to a usable range, and coatings having superior wear resistance can be obtained at high speeds. This will be described on the basis of experiments performed under the conditions shown in Table 2, whose results are plotted in the graph of FIG. 13.

Table 2

| Experimental conditions | |
|---|---|
| Temperature of the bath (° C) | 56 to 76° C at intervals of 2° C |
| Current density (A/dm$^2$) | 370 |
| Rotating speed (m/sec) | 2 |
| Plating period (min) | 20 |
| Type of the bath | Silicofluoride bath |

Figure 13:
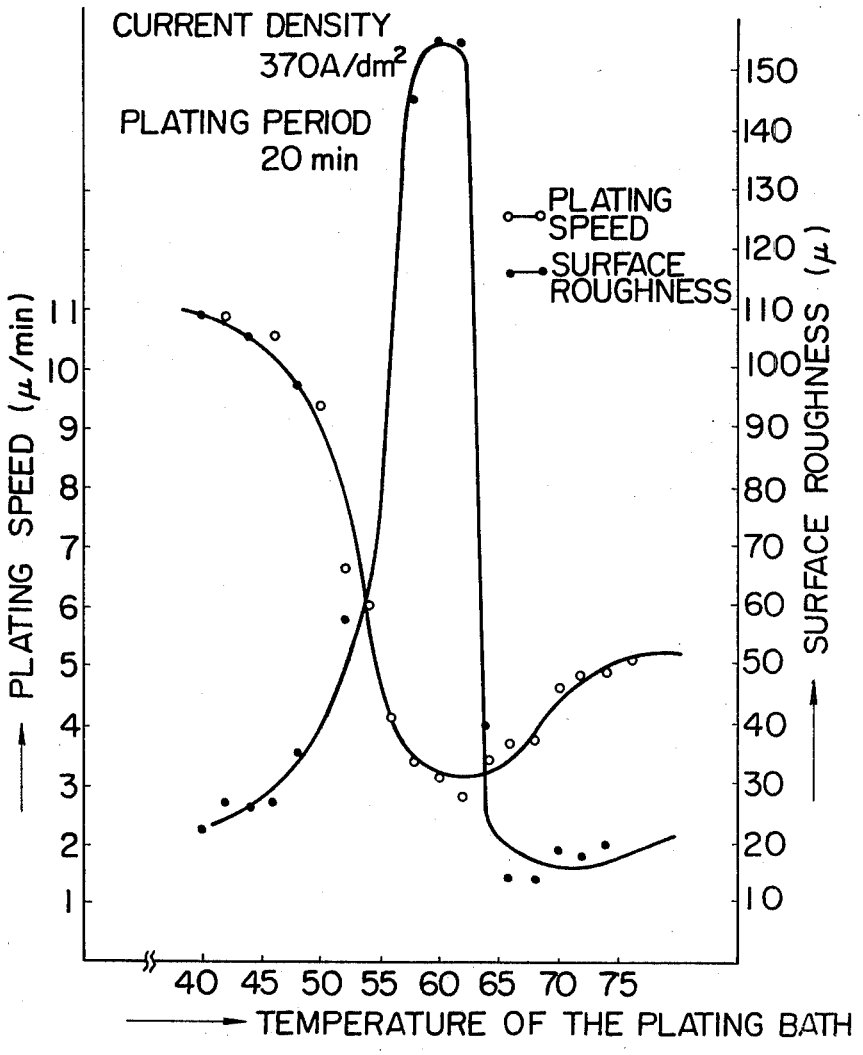
FIG. 13 is a graphical representation showing experimental results based on the high speed chromium plating method of this invention.

The graph of FIG. 13 shows the relationship between the temperature of the bath plotted on the abscissa in ° C, the speed of plating in $\mu$/min plotted on the left ordinate, and the surface roughness in $\mu$ plotted on the right ordinate. As can be seen, the surface roughness is relatively small when the temperature of the plating bath is below 50° C, increases sharply above 50° C, peaks at about 60° C, and decreases sharply above 65° C.

On the other hand, the plating speed is very high up to about 50° C, becomes relatively low within a temperature range of 50° to 65° C, and tends to increase again when the temperature exceeds 65° C.

At temperatures exceeding 95° C the material lining the plating tank begins to degrade and deteriorate. Accordingly, the temperature of the bath is preferably limited to 80° C.

From the group of FIG. 13, it can be seen that the plating speed at a bath temperature of 65° C or more is within the range of about 3.5 to 5 $\mu$/min. This speed is about 5 times as great as that obtained in conventional chromium plating methods.

What is claimed is:

1. A method for the high speed chromium plating of cylindrical articles, such as piston rings, cylinder liners, and the like, characterized by: disposing a cylindrical cathodic article in a plating bath in a generally concentric position with respect to a stationary anode such that the peripheral surface to be plated is opposite the anode and spaced therefrom a predetermined distance, rotating the article such that the side thereof facing the anode has a peripheral speed of about 1 to 4 m/sec. to generate a turbulent flow in the plating bath, passing an electric current having a density of about 200 to 600 A/dm$^2$ between said electrodes and maintaining the temperature of the plating bath at 20° to 50° C.

2. The method for high speed chromium plating according to claim 1, characterized in that the anode comprises a plurality of rectangular poles each having a thickness $t$ and a width $w$ wherein $t \leqq w$, the poles being radially disposed such that the thickness dimension of each pole faces the article and is spaced therefrom a distance of about 0.1 to 4$t$ cm, to thereby generate a turbulent flow at the surface of the article in the plating bath.

3. A method for the high speed chromium plating of cylindrical articles, such as piston rings, cylinder liners, and the like, characterized by: disposing a cylindrical cathodic article in a plating bath in a generally concentric position with respect to a stationary anode such that the peripheral surface to be plated is opposite the anode and spaced therefrom a predetermined distance, rotating the article such that the side thereof facing the anode has a peripheral speed of about 1 to 4 m/sec. to generate a turbulent flow in the plating bath, passing an electric current having a density of about 200 to 600 A/dm$^2$ between said electrodes and maintaining the temperature of the plating bath at 65° C to 80° C.

4. The method for high speed chromium plating according to claim 3, characterized in that the anode comprises a plurality of rectangular poles each having a thickness $t$ and a width $w$ wherein $t \leqq w$, the poles being radially disposed such that the thickness dimension of each pole faces the article and is spaced thereform a distance of about 0.1 to 4$t$ cm, to thereby generate a turbulent flow at the surface of the article in the plating bath.

* * * * *

UNITED STATES PATENT AND TRADEMARK OFFICE

Certificate

Patent No. 4,080,268 Patented March 21, 1978

Shoji Suzuki, Keiichi Yoda, Hiroshi Suzuki, Isao Yaguchi and Hitoshi Karasawa

Application having been made by Shoji Suzuki, Keiichi Yoda, Hiroshi Suzuki, Isao Yaguchi and Hitoshi Karasawa, the inventors named in the patent above identified, and Nippon Piston Ring Co., Ltd., Tokyo, Japan, the assignee, for the issuance of a certificate under the provisions of Title 35, Section 256, of the United States Code, adding the name of Glenn R. Schaer as a joint inventor, and a showing and proof of facts satisfying the requirements of the said section having been submitted, it is this 29th day of April 1980, certified that the name of the said Glenn R. Schaer is hereby added to the said patent as a joint inventor with the said Shoji Suzuki, Keiichi Yoda, Hiroshi Suzuki, Isao Yaguchi and Hitoshi Karasawa.

FRED W. SHERLING,
*Associate Solicitor.*